US005421417A

United States Patent [19]

Kraft et al.

[11] Patent Number: 5,421,417

[45] Date of Patent: Jun. 6, 1995

[54] LOCK FOR RETAINING STABILIZER IN RAISED POSITION

[75] Inventors: Troy D. Kraft; Henry J. Weber, both of Bismarck, N. Dak.

[73] Assignee: Clark Equipment Company, South Bend, Ind.

[21] Appl. No.: 6,810

[22] Filed: Jan. 21, 1993

[51] Int. Cl.[6] ..... E02F 3/32

[52] U.S. Cl. ..... 172/274; 403/321

[58] Field of Search ..... 172/272, 274; 37/231, 37/234, 235, 236; 212/189; 403/321, 187; 414/686

[56] References Cited

U.S. PATENT DOCUMENTS

| | | | |
|---|---|---|---|
| 941,933 | 11/1909 | Logan et al. | 403/321 |
| 1,132,335 | 3/1915 | Graves | 403/321 |
| 1,217,640 | 2/1917 | Roebuck | 403/321 X |
| 2,981,343 | 4/1961 | Berky | 172/274 |
| 4,034,998 | 7/1977 | Iijima et al. | 172/272 X |
| 4,343,389 | 8/1982 | Ponstein | 414/686 X |
| 4,347,031 | 8/1982 | Friesen et al. | 172/274 X |
| 4,583,906 | 4/1986 | Frisbee | 414/686 |
| 4,793,764 | 12/1988 | Hamm | 172/274 X |
| 4,921,392 | 5/1990 | Wagner | 414/695 |
| 4,974,348 | 12/1990 | Wallace | 37/87 |

FOREIGN PATENT DOCUMENTS

| | | | |
|---|---|---|---|
| 54757 | 6/1943 | Netherlands | 172/274 |

*Primary Examiner*—Randolph A. Reese
*Assistant Examiner*—Christopher J. Novosad
*Attorney, Agent, or Firm*—Westman, Champlin & Kelly

[57] ABSTRACT

A backhoe or other similar earth working apparatus has a frame that mounts on a vehicle, such as a skid steer loader or tractor. A pair of stabilizer arms mounted to the frame member and pivotable along an arcuate path between raised and lowered positions, each have a stabilizer locking device. The stabilizer locking device comprises a hook member mounted on an exterior surface of an outer end of each stabilizer arm, and a latch member mounted to the frame member for releasably engaging each hook member such that when the hook member is engaged, the stabilizer arm is retained in the raised position.

10 Claims, 3 Drawing Sheets

LOCK FOR RETAINING STABILIZER IN RAISED POSITION

BACKGROUND OF THE INVENTION

The present invention relates generally to stabilizers for use with backhoes or other similar vehicle mounted excavating devices, and more particularly, to a locking mechanism for the stabilizers while in a raised position.

Backhoe frames typically include stabilizers on their outboard sides generally perpendicular to the longitudinal axis of the backhoe boom to support the backhoe and the mounting vehicle during use. Stabilizers which pivot between raised and lowered or working positions are individually driven by hydraulic cylinders in response to operator actuation. When lowered during excavation, the stabilizers stabilize the vehicle to avoid lateral and/or forward movement when working the backhoe. A hydraulic circuit lock-out is often used in the hydraulic drive circuit for the stabilizer hydraulic cylinders to prevent fluid from leaking from the hydraulic cylinders after the stabilizers have been positioned. The hydraulic locks work with the stabilizers in their retracted position when the vehicle is traveling or being stored, and in their extended position during excavation.

However, a problem has arisen with the lock-out in the hydraulic circuit, even those with pilot operated check valves, in that when the stabilizers reach the raised or stored position a substantial amount of downward pivoting of the stabilizer occurs with little movement of the rod of the hydraulic cylinders permitted by any small hydraulic fluid leaks from the hydraulic cylinders.

SUMMARY OF THE INVENTION

The present invention relates to locks for pivoting stabilizer arms of a backhoe frame. In the disclosed embodiment, a pair of stabilizer arms are mounted to the rear exterior portion of a backhoe frame on opposite sides of the backhoe. The stabilizer arms are pivotable along an arcuate path from a lowered position where the stabilizer arms engage the ground and lift the wheels of the vehicle mounting the backhoe during working of the backhoe, to a raised position where the stabilizer arms extend upwardly are positioned and close to the backhoe frame for storage and transport of the backhoe and/or vehicle. A locking mechanism retains each stabilizer arm in the retracted position.

In one embodiment, each locking mechanism includes a hook member mounted to the stabilizer arm and a latch member mounted to the backhoe vehicle frame, which slides into locking engagement with the hook member as the stabilizer arm is raised.

DETAILED DESCRIPTION OF THE PREFERRED EMBODIMENTS

Figure 1:
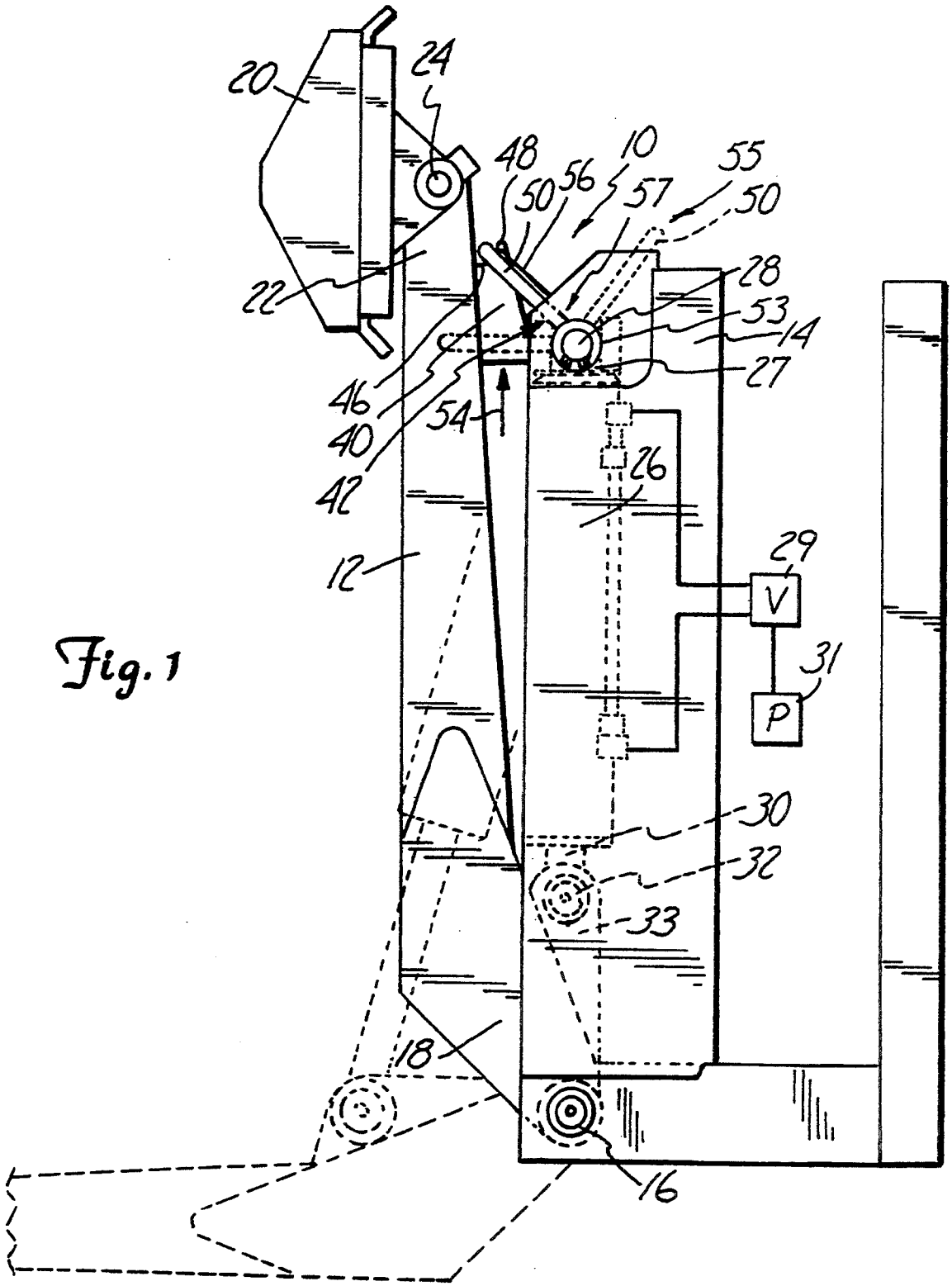
FIG. 1 is a partial side elevational view of a portion of a backhoe mounting frame employing the present invention.

One side of a conventional backhoe mounting generally upright frame member 14 is shown in FIG. 1. A frame 14 pivotally mounts at least one stabilizer arm 12 on the side of the generally upright frame member 14 and on a fore and aft extending first pin 16. A hydraulic cylinder 26 is operated to cause the stabilizer arm 12 mounted to upright frame member 14 to be pivotable along an arcuate path between a raised position extending uprightly and adjacent the upright frame member 14 and a lowered position. A separate lock mechanism 10, one for each stabilizer arm 12, prevents undesired downward pivoting movement of the stabilizer arm 12 from its raised position. As mentioned above, when the stabilizer arm is in the raised position a substantial amount of pivoting of the stabilizer arm 12 occurs due to any small leakage of hydraulic fluid from hydraulic cylinder 26, and the stabilizers tend to pivot out of their stored position.

First pin 16 mounts an inner end 18 of the stabilizer arm 12 to the backhoe frame 14, which is in turn mounted on a vehicle (not shown). In the raised position, the stabilizer arm 12 extends upward from the first pin 16 and gravity tends to load it downwardly. The first pin 16 permits the stabilizer arm 12 to pivot along an arcuate path from a lowered or extended, working position shown in broken lines in FIG. 1 to a raised or retracted, storage or transport position shown in solid lines in FIG. 1. A stabilizer foot 20, located at an outer end 22 of the stabilizer arm 12, engages the ground surface when the stabilizer arm 12 is lowered. A second pin 24 pivotally mounts the stabilizer foot 20 to the stabilizer arm and permits the foot to self-level itself on the ground surface when the stabilizer arm 12 is in the lowered position. The precise shape, size and location of the stabilizer arm 12 and stabilizer foot 20 can vary according to particular design specifications.

A third pin 28 connects a base end of hydraulic cylinder 26 or other actuator drive between flanges 27 on the backhoe frame 14. A fourth pin 32 connects an extendable and retractable piston rod 30 to a bracket 33 at the inner end 18 of the stabilizer arm 12. A hydraulic pump 31 and control valve 29 (both shown schematically) drive the hydraulic cylinder 26. An operator individually controls the hydraulic cylinders (one on each of the sides of the backhoe frame) to drive each stabilizer arm 12 between the lowered working position and the raised or stored travel position.

The piston rod 30 of the hydraulic cylinder 26 can also be attached to the outer end 22 of the stabilizer arm 12. In such an arrangement, the base end of the cylinder and pin 28 are typically located in close proximity to the first pivot pin 16.

Figure 2:
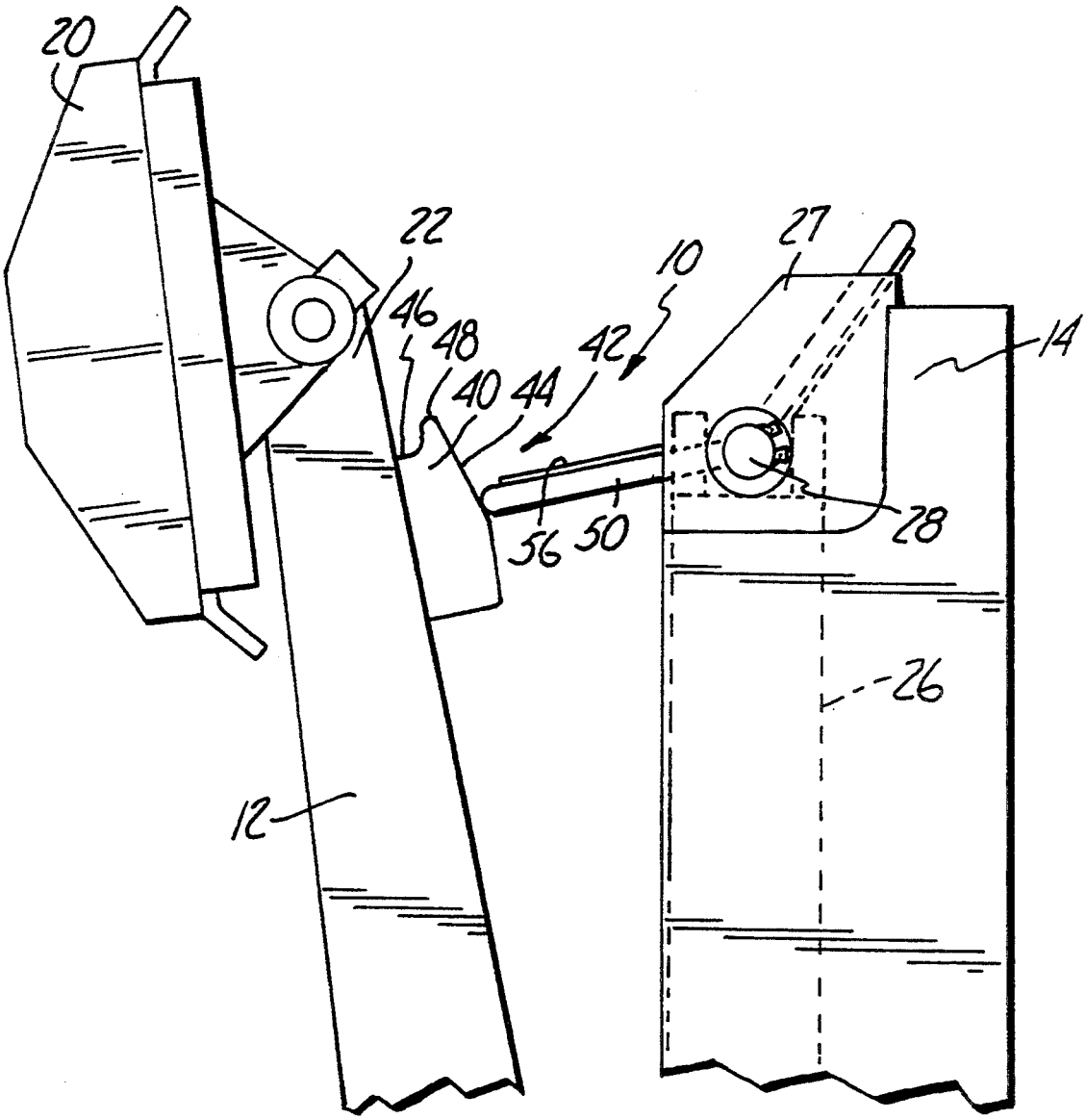
FIG. 2 is an enlarged fragmentary view of the present invention showing the latch member contacting the hook member as the stabilizer arm is being pivoted to the raised position.
Figure 3:
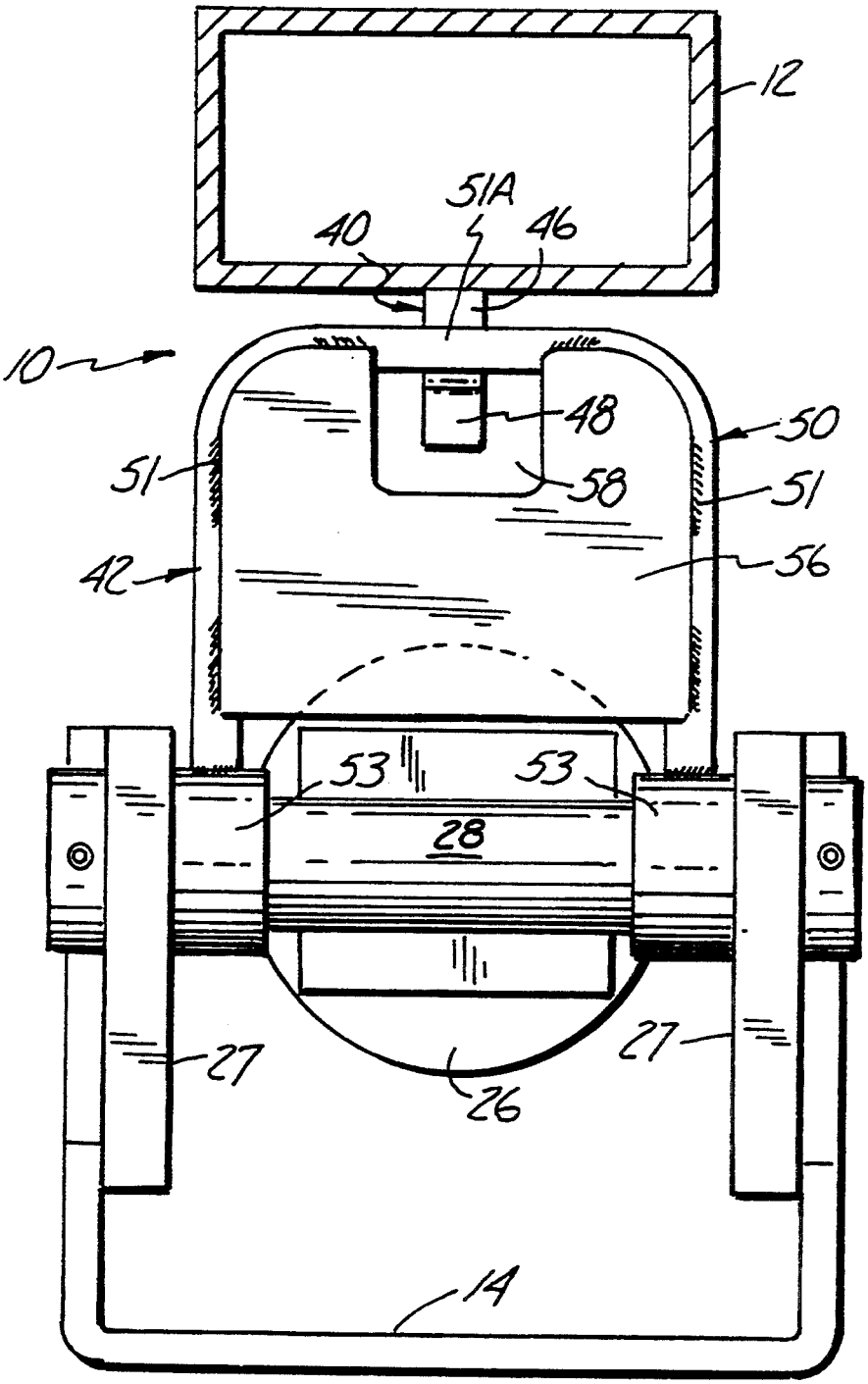
FIG. 3 is a top plan view of a portion of the backhoe frame employing the present invention.

Referring to FIGS. 1–3, the stabilizer lock mechanism 10 includes a hook member 40 mounted on an exterior surface of the outer end 22 of the stabilizer arm 12, and a latch member 42 mounted to the vehicle frame 14 for releasably engaging the hook member 40 such that when the hook member is engaged, the stabilizer arm 12 is retained in the raised position.

The hook member 40 is a bar that has a tapered edge 44 on its outermost surface and a recess 46. The combination of the tapered edge 44, which tapers toward an exterior surface of the stabilizer arm on which it is mounted in a direction toward the outer end 22 of the stabilizer arm 12 on which it is mounted. The recess forms a flange or dog 48 for engaging the latch member 42. As the stabilizer arm 12 is pivoted up and is near its raised position, the latch member 42 will be contacted by and slide along the tapered edge 44 of the hook member 40 until it slides over the flange 48, and sets in the recess 46. The latch member 42 automatically latches to retain the stabilizer arm 12 in the raised position until the latch is released.

The latch member 42 has a U-shaped latch frame 50 having a pair of legs 51 each with a hub 53 at the outer end. The legs 51 straddle the base end of cylinder 26 and the hubs 53 fit between the cylinder and the support flanges 27 and are pivotally mounted on pin 28 that is used to support the base end of hydraulic cylinder 26. A closed end 51A of the U-shaped latch frame 50 acts as a contact surface for engaging the hook member 40 when the stabilizer arm 12 is raised. The particular shape of the U-shaped latch frame 50 can vary so long as a contact surface is maintained. The hubs 53 allow the latch member 42 to pivot from a down position, shown in broken lines at 54 in FIG. 1, to an up or released position shown in broken lines at 55, to a locked position shown in solid lines 57. When the latch member 42 is in the down position 54, it rests generally perpendicular to the hydraulic cylinder 26 to automatically engage the hook member 40 as the stabilizer arm 12 moves to the raised position. The U-shaped latch frame 50 rests in the up or released position 55 while the stabilizer arm 12 is in the lowered position. In the locked position 57 the latch member 42 engages the hook member 40 and thereby prevents undesirable pivoting of the stabilizer arm 12.

Referring to FIG. 3, a plate member 56 positioned on the legs 51 substantially covers the space between the legs of the U-shaped latch frame 50. The plate member 56 has a notch 58 therein permitting the flange 48 of the hook member 40 to engage the closed end 50A of the U-shaped latch frame 50.

In operation with the stabilizer arm 12 up, an operator of the backhoe raises the stabilizer arm 12 using valve 29 to release any load on the latch. The operator manually lifts the latch member 42 from the hook member 40 in order release the lock to permit lowering the stabilizer arm 12. With the latch member 42 disengaged from the hook member 40, the operator activates the hydraulic cylinder 26 so that the piston rod 30 extends. The force on the stabilizer arm 12 at and along an arcuate path about the first pivot pin 16. The stabilizer arm 12 continues to move downward until the stabilizer foot 20 engages the ground surface so as to stabilize the vehicle for using the backhoe or other similar device.

Before raising the stabilizer arm 12, the operator manually places the latch member 42 in the down position where it protrudes laterally from pin 28 as shown in broken lines in FIG. 1 at 53. As the stabilizer arm 12 is raised along the arcuate path, the tapered edge 44 of the hook member 40 contacts the closed end 51A of the U-shaped latch frame 50 as seen in FIG. 2. The closed end 51A of the U-shaped latch frame 50 slides along the tapered edge 44 of the hook member 40 as the stabilizer arm 12 pivots upward until the U-shaped latch frame 50 raises over the latch dog 48 and settles into the recess 46 thereby automatically engaging the hook member 40 and retaining the stabilizer arm in the raised position. In this position, the lock mechanism 10 prevents any undesired lateral or downward movement of the stabilizer arm 12, which can result from little movement of the piston rod 30 of the hydraulic cylinder 26 due to any small hydraulic fluid leak from the hydraulic cylinder circuit.

The hook 40 and latch member 42 form lock members for the stabilizer 12. Thus, one of the lock members has a guide surface which slides against the other lock member as the stabilizer arm approaches its raised position, and guides the other lock member to a position to automatically engage the one lock member as the stabilizer arm 12 reaches its raised position.

Although the present invention has been described with reference to preferred embodiments, workers skilled in the art will recognize that changes can be made in form and detail without departing from the spirit and scope of the invention.

What is claimed is:

1. In an earth working machine having a generally upright frame member and at least one stabilizer arm mounted to the frame member and pivotable along an arcuate path between a raised position extending uprightly and adjacent to the upright frame member and a lowered position extending downwardly to engage the ground for operation of the machine, and a stabilizer arm drive for driving and positioning the stabilizer arm between the raised and lowered positions, the improvement comprising:

a hook member mounted on an exterior surface of an outer end portion of the stabilizer arm and having an edge surface which tapers toward the exterior surface of the stabilizer arm in a direction toward an outer end of the stabilizer arm;

a latch member mounted to the frame member and being positioned for releasably engaging the hook member when the stabilizer arm is moved to its raised position, the latch member having a contact surface which slides against the edge surface of the hook member as the stabilizer arm approaches its raised position until the latch member automatically engages the hook member to retain the stabilizer arm in the raised position adjacent the upright frame member.

2. The improvement of claim 1, wherein the stabilizer arm drive is a hydraulic cylinder, an upper end thereof being connected to the frame member by a first pin and a lower end thereof being connected to the stabilizer arm by a second pin.

3. The improvement of claim 2, wherein the latch member is pivotally mounted to the first pin and to the frame member.

4. The improvement of claim 1, wherein the latch member includes a U-shaped latch frame having a pair of spaced latch legs, hub means at an end of each latch leg for pivotally mounting the latch frame to the frame member.

5. The improvement of claim 4, wherein the latch member further includes a plate member positioned on the latch legs of the U-shaped latch frame, the plate member having a notch therein for permitting an end portion of the U-shaped latch to fit over the hook member.

6. A stabilizer assembly for a backhoe unit comprising:

at least one stabilizer arm having a stabilizer foot mounted at an outer end thereof for engaging the ground, first pivot means mounted at an inner end of the stabilizer arm for securing the stabilizer arm to the backhoe unit such that the stabilizer arm is pivotable along an arcuate path from lowered position wherein the stabilizer arm engages the ground for working of the backhoe unit to a raised position wherein the stabilizer arm extends upwardly from the ground for storage and transport of the backhoe unit, and a hook member mounted adjacent the outer end of the stabilizer arm;

actuator means for raising and lowering the stabilizer arm, the actuator means being connected to the stabilizer arm and to the backhoe unit;

a latch member pivotably mounted to the backhoe unit in position to engage the hook member as the stabilizer arm is pivoted to the raised position such that the stabilizer arm is maintained in the raised position when the hook member is engaged with the latch member; and wherein the hook member has an exterior edge which tapers toward the stabilizer arm in direction toward the outer end of the stabilizer arm, and wherein the latch member has a coupling surface which rides against the tapered edge of the hook member as the stabilizer arm approaches the raised position wherein the latch member automatically engages the hook member when the stabilizer arm reaches the raised position.

7. The stabilizer assembly as in claim 6, wherein the latch member is U-shaped, and wherein the coupling surface is positioned between a pair of legs of the latch member, and wherein the latch member further includes hub means at each end of the legs for pivotally mounting the latch member to the backhoe unit.

8. The stabilizer assembly as in claim 7, wherein the actuator is a hydraulic cylinder.

9. The stabilizer assembly as in claim 7, wherein the latch member further includes a plate member positioned on the legs of the U-shaped latch member, the plate member having a notch therein such that the contact surface can engage the hook member.

10. A backhoe having a frame, at least one stabilizer arm, a hydraulic actuator for raising each stabilizer arm along an arcuate path to a stored position wherein the stabilizers bars are not engaged with a ground surface and lowering each stabilizer arm along the arcuate path to a working position wherein the stabilizer arms are engaged with the ground, and a stabilizer locking device comprising:

a hook member mounted on one end of the stabilizer arm, the hook member having a tapered edge which tapers inward towards the stabilizer, and a recess which in combination with the tapered edge forms a flange on the hook member; and a latch member pivotably mounted to the frame which slides against the tapered edge of the hook member along an upper portion of the arcuate path until the latch member slides over the flange, into the recess and thereby automatically engages the hook member when the stabilizer arm is in the stored position.

* * * * *